US011659628B2

(12) United States Patent
Crowe et al.

(10) Patent No.: US 11,659,628 B2
(45) **Date of Patent: *May 23, 2023**

(54) VAPORIZER

(71) Applicant: Vuber Technologies, LLC, Seattle, WA (US)

(72) Inventors: David Ryan Crowe, Seattle, WA (US); Anthony Disanto, Hixson, TN (US); Tony Chang, Bozeman, MT (US)

( * ) Notice: Subject to any disclaimer, the term of this patent is extended or adjusted under 35 U.S.C. 154(b) by 288 days.

This patent is subject to a terminal disclaimer.

(21) Appl. No.: 17/088,384

(22) Filed: Nov. 3, 2020

(65) Prior Publication Data

US 2021/0112867 A1 Apr. 22, 2021

Related U.S. Application Data

(63) Continuation of application No. 15/915,165, filed on Mar. 8, 2018, now Pat. No. 10,820,634.

(60) Provisional application No. 62/468,620, filed on Mar. 8, 2017.

(51) Int. Cl.

| | |
|---|---|
| ***A24F 40/42*** | (2020.01) |
| ***A24F 47/00*** | (2020.01) |
| ***H05B 3/44*** | (2006.01) |
| ***H05B 1/02*** | (2006.01) |
| ***A24B 15/167*** | (2020.01) |
| ***A24F 40/44*** | (2020.01) |
| ***A24F 40/46*** | (2020.01) |
| ***A24F 40/60*** | (2020.01) |
| *A24F 40/10* | (2020.01) |

(52) U.S. Cl.

CPC ..... *H05B 1/0227* (2013.01); *A24B 15/167* (2016.11); *A24F 40/42* (2020.01); *A24F 40/44* (2020.01); *A24F 40/46* (2020.01); *A24F 40/60* (2020.01); *H05B 3/44* (2013.01); *A24F 40/10* (2020.01)

(58) Field of Classification Search

None

See application file for complete search history.

(56) References Cited

U.S. PATENT DOCUMENTS

| | | | | |
|---|---|---|---|---|
| 5,408,574 | A | 4/1995 | Deevi et al. | |
| 10,182,599 | B2 | 1/2019 | Zhu | |
| 2012/0174914 | A1 | 7/2012 | Pirshafiey et al. | |
| 2017/0071255 | A1 | 3/2017 | Revell | |
| 2018/0255835 | A1 * | 9/2018 | Crowe | A24F 40/42 |
| 2018/0317551 | A1 * | 11/2018 | Daryani | A24F 40/48 |
| 2019/0008207 | A1 * | 1/2019 | Crowe | A24F 40/46 |
| 2020/0060342 | A1 * | 2/2020 | Woodbine | B05B 11/3015 |
| 2023/0091269 | A1 * | 3/2023 | Newton | A24F 40/10 |

FOREIGN PATENT DOCUMENTS

WO 2017045897 A1 3/2017

* cited by examiner

*Primary Examiner* — Joseph M. Pelham

(74) *Attorney, Agent, or Firm* — Walker Griffin Weitzel; Alloy Patent Law

(57) ABSTRACT

An extract vaporizer has been disclosed. The vaporizer includes an adjustable-volume reservoir adapted to contain extract. The adjustable-volume reservoir is generally cylindrical. The vaporizer further includes a vaporization chamber. The reservoir and vaporization chamber are connected by a port. The vaporizer further includes a heating element proximal to the vaporization chamber. The vaporizer further includes a conduit adapted to ventilate the vaporization chamber.

11 Claims, 4 Drawing Sheets

Figure 1: Section View of Device
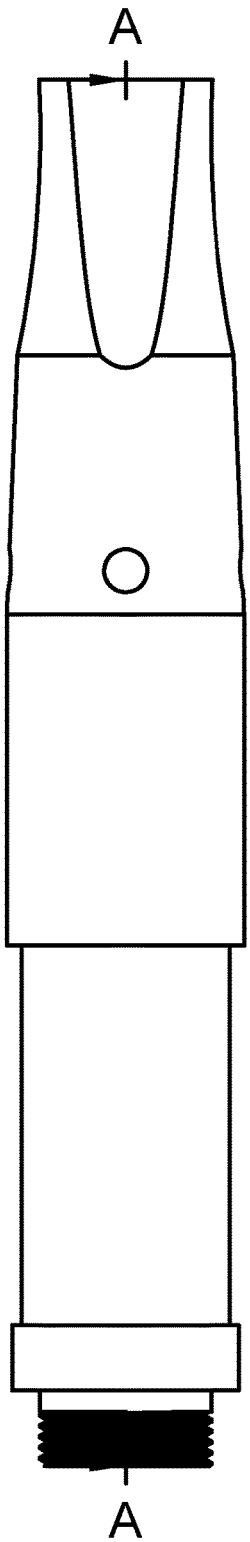
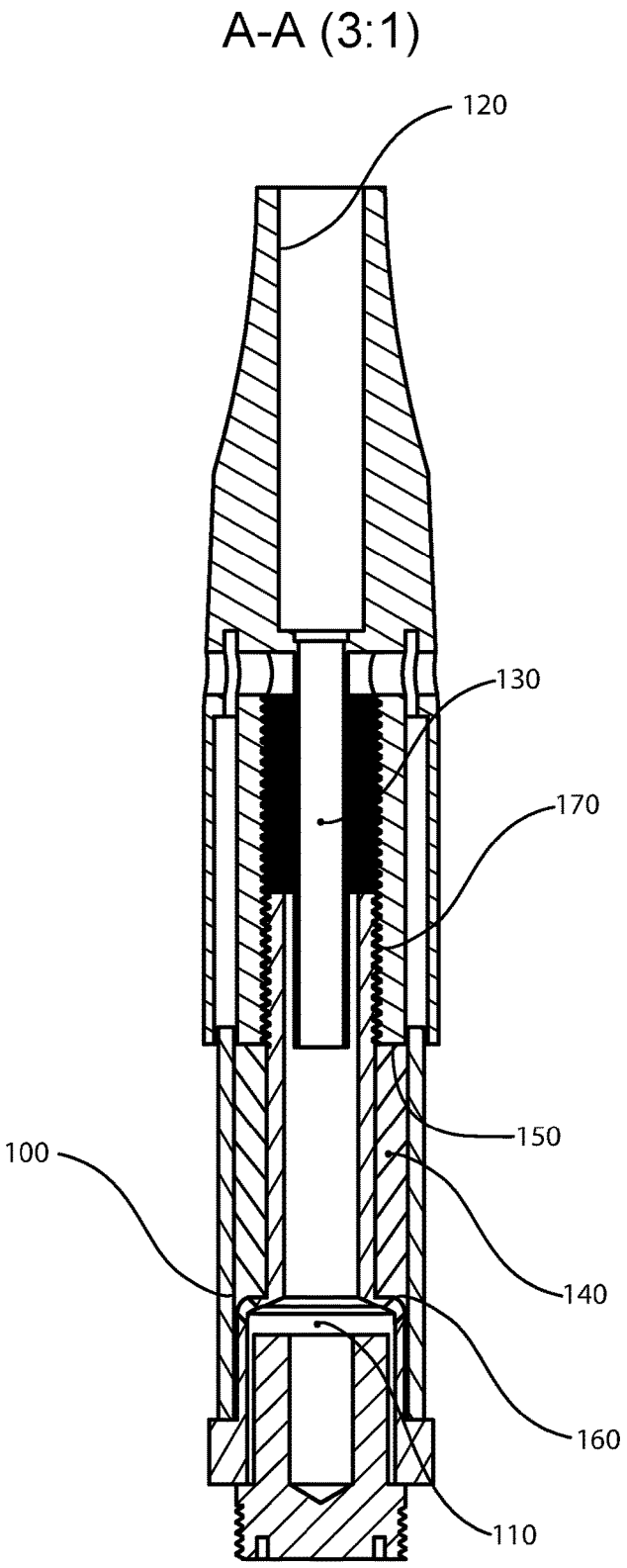

Figure 2: Exploded Section View of the Device
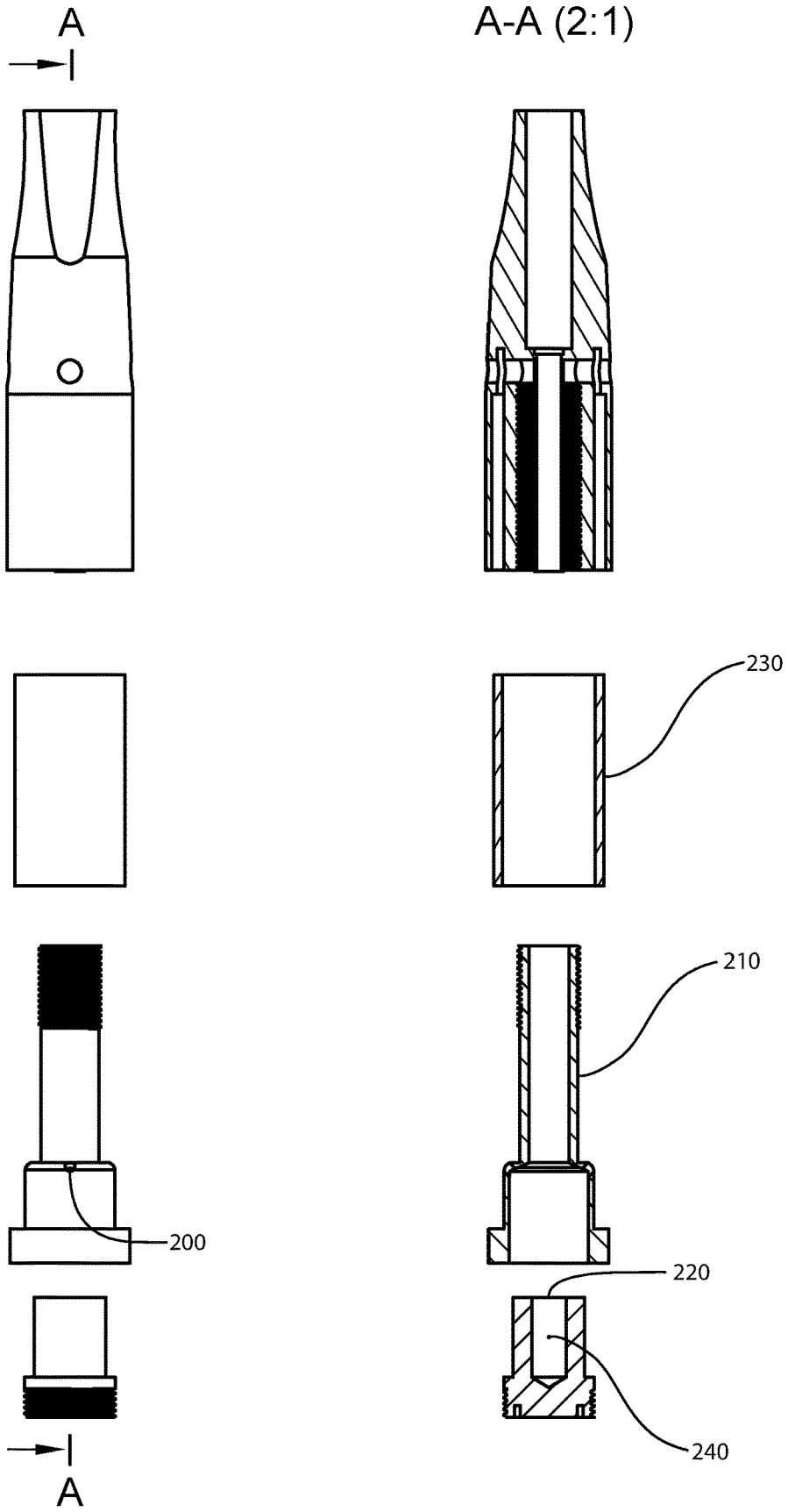

Figure 3: Isometric View of Device
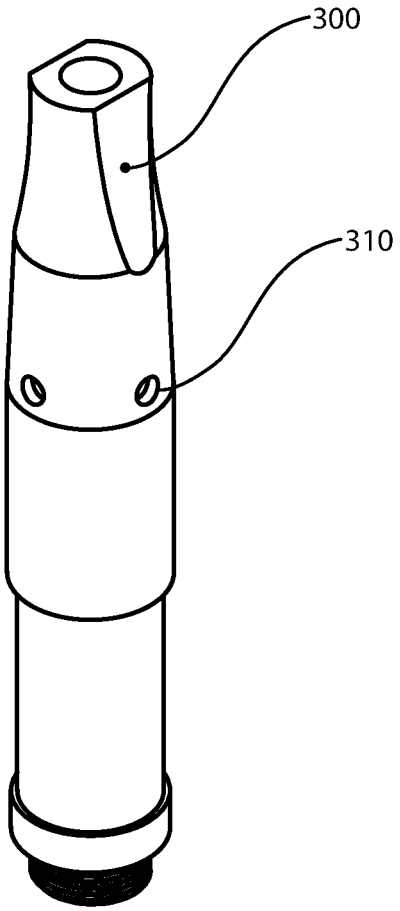

Figure 4: Exploded View of Device
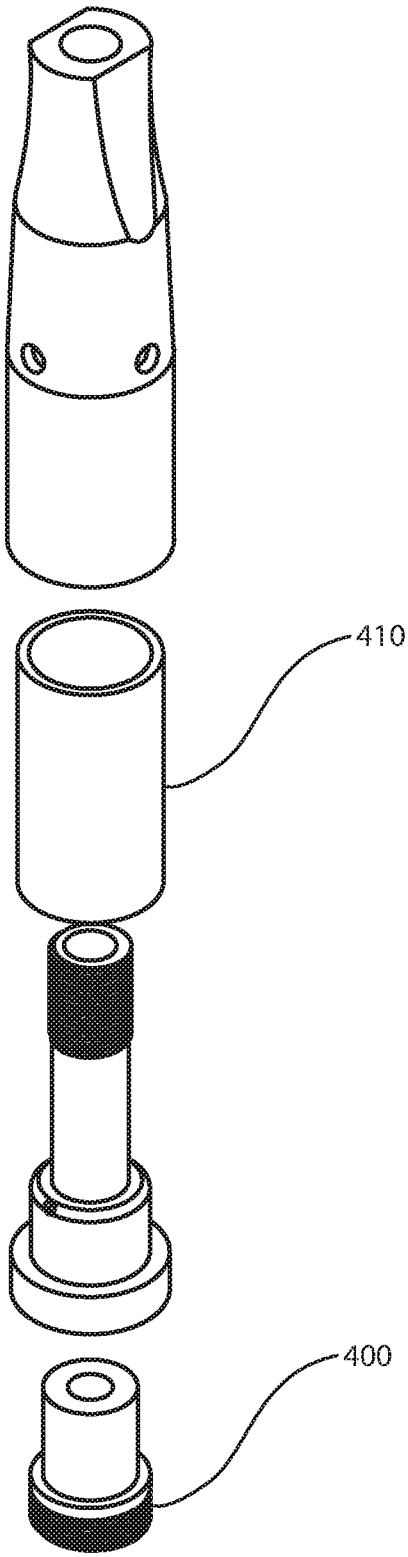

VAPORIZER

FIELD OF THE DISCLOSURE

The overall field of invention is devices and methods for vaporization of liquids and solids.

BACKGROUND

Cannabis has long been used medicinally and recreationally. Cannabis contains numerous compounds known as cannabinoids. Cannabinoids may be medicinal and/or psychoactive. Tetrahydrocannabinol (THC) is the primary psychoactive compound, though it also has medicinal properties. Cannabidiol (CBD) is the primary medicinal compound, and it may have little to no psychoactive effect. THC and CBD are considered the Active Compounds.

Active Compounds may be extracted from the cannabis plant through a wide variety of processes, and the cannabinoid extract (Extract) take many forms and consistencies. Chemically, Extracts may vary significantly in their chemical content, ranging from almost entirely THC, to almost entirely CBD, along with varying levels of purity regarding non-medicinal and non-psychoactive compounds. Physically, Extracts also vary significantly, including liquid oils of widely varying viscosity, solid waxes of widely varying plasticity, and other semi-solid forms that exist as combinations of oil and wax. Extracts of different consistencies may be colloquially referred to as oil, wax, honeycomb, shatter, crumble, sap, budder, and pull-and-snap. The chemical content and form or consistency of Extract depends on factors including the plant feedstock from which the Active Compounds are extracted, the specific process through which extraction occurs, and any post-extraction processing such as dilution, mixing, or physical processing. Extraction technology is advancing, and processes include butane, $C0_2$, and other hydrocarbon extraction processes are common.

Traditionally, Active Compounds were introduced into the human body for medicinal or psychoactive purposes by smoking or eating the cannabis plant. Recently, vaporization has gained prevalence as a means for consumption. Vaporization differs from smoking in that the cannabis plant or Extract is heated to a temperature high enough to volatilize Active Compounds into vapor but low enough to avoid combustion. Combustion products and byproducts, such as smoke and NOx, may be undesirable for consumption for a variety of reasons, including health effects and flavor preference. Vaporization optimally produces no smoke. Vaporization is also a highly controllable process, whereby the amount of heating applied to either the plant or Extract can be precisely controlled, and the size of the resulting dose of Active Compounds is much more predictable than the size of a dose taken through smoking.

Devices used for vaporizing extract (Vaporizers) generally must be adapted to operate with a specific type or consistency of extract. Most Vaporizers that are adapted to operate using oil, for example, operate by a wicking mechanism in which a wick transports liquid Extract from a reservoir to a heating element. Vaporizers adapted to vaporize solid Extracts generally require the user to physically introduce a portion of solid Extract to the heating element using a small scooping tool. The process of introducing solid Extract to the heating element is often referred to as "Dabbing."

Vaporizers adapted for use with liquid Extracts are generally easier to operate. Because the wicking mechanism automatically introduces Extract to the heating element as Extract is vaporized, the user is required only to operate the state or temperature of the heating element, without need for filling, monitoring, or refilling the extract in contact with the heating element. Frequently the liquid Extract is distributed as a cartridge, in which the liquid Extract is contained in a reservoir that is adapted to connect directly to a Vaporizer. Cartridges relieve the user of having interact with the liquid Extract, and therefore are significantly more convenient than fillable reservoir Vaporizers. Solid Extract, for use in Dabbing, is typically distributed in containers such as baggies, jars, tins, or bottles. Solid Extract has not been traditionally available in a cartridge-type container adapted for ready use with a Vaporizer, but instead must be removed from the distribution container for use in Dabbing. In general, Vaporizers adapted for use with liquid Extract are easier to operate and refill.

Liquid Extracts have certain characteristics that are undesirable when compared to solid Extracts. Generally, liquid Extracts are comprised of some portion of solvent to control viscosity and osmotic properties. Many users prefer not to vaporize and inhale solvent. Additionally, cartridge reservoirs, especially those adapted for use with a wicking mechanism, are prone to leaking. Solid or semi-solid Extracts generally are produced without a solvent in the distributed product. Additionally, solid and semi-solid Extracts are immune to leakage due to their ability to support shear forces.

All currently available Vaporizers suffer from at least one of the following disadvantages: 1) Users are required to inhale vaporized solvent, 2) Extract reservoirs are prone to leaking, 3) Dabbing process is cumbersome.

SUMMARY

It is the object of the present invention to eliminate the disadvantages in currently available Vaporizers. The present invention is adapted for use with semi-solid Extracts, which are immune to leakage and do not contain solvents. Furthermore, the present invention is easily operated by users and does not require Dabbing.

BRIEF DESCRIPTION OF DRAWINGS

FIG. I Shows a front view and section view of the Vaporizer

FIG. 2 Shows an exploded side view and section view of the Vaporizer

FIG. 3 Shows an isometric view of the Vaporizer

FIG. 4 Shows an isometric exploded view of the Vaporizer

DEFINITIONS

Vapor: Gaseous or suspended liquid condensate Extract suitable for inhalation.

Dabbing: Applying solid Extract to a heating element with a tool such as a small scoop or spatula.

Top: The direction tending toward the mouthpiece tip of the device

Bottom: The direction tending toward the distal end of the device.

THC: Tetrahydrocannabinol

CBD: Cannabidiol

Active Compounds: THC and CBD

Vaporizers: Devices used for vaporizing Extract

DETAILED DESCRIPTION

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used-to the extent possible-in combination with and/or in the context of other particular aspects and embodiments of the invention, and in the invention generally The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limits include both numbers. For example, "25 to 100" means a range whose lower limit is 25 and upper limit is 100, and includes both 25 and 100.

The present invention is a device that produces Vapor. Vapor is produced by a process in which a user operates the device to move Extract from an Extract Reservoir 100 into a Vaporization Chamber 110. The user operates the device to create a pressure gradient between the Extract Reservoir 100 and the Vaporization Chamber 110, and the Extract flows as a result. In the preferred embodiment, the pressure gradient is achieved by reducing the volume of the Reservoir 100, consequently raising its internal pressure, which urges the contained Extract out through a port and into the Vaporization Chamber 110. The user may then operate the device in order to apply heat energy to Extract in the Vaporization Chamber 110. The heat causes the Extract to volatilize into Vapor. As Vapor is produced, it can be conducted through a channel 130 and inhaled by the user through the egress port 120.

FIG. I is a front view and section view of the Vaporizer. The Vaporizer contains a volume of Extract 140 in an adjustable-volume Extract reservoir 100. In the preferred embodiment, the reservoir 100 is a hollow cylinder, substantially closed to the environment. The volume of the cylinder can be adjusted by altering the position of the cylinder top 150 with respect to the cylinder bottom 160. In the preferred embodiment, the position is adjustable by means of a threaded feature 170 extending through the center of the hollow cylindrical volume, which interfaces with threading on the cylinder top 150, and causes the cylinder top to translate toward or away from the cylinder bottom when the top is rotated about the long axis of the threaded feature 170. In this way, a user can reduce the reservoir size by "screwing down" the cylinder top 150. In some alternative embodiments, the volume of the reservoir is adjusted by other means, including squeezing the reservoir, compressing the reservoir, or pressing on the surfaces of the reservoir. In other alternative embodiments, the reservoir may change size as a result of other electrical or mechanical actuation.

FIG. 2 is an exploded side view and section view of the Vaporizer. A feeder port 200 or ports extend through the Inner Wall 210 of the Extract Reservoir 100, proximal to the Vaporization Chamber Floor 220. As the volume of the Reservoir 100 is reduced, any Extract 140 contained in the reservoir is urged through the feeder port 200. The size and number of feeder ports 200 may be modified to operate with Extracts of varying viscosity or plasticity, with higher-viscosity Extracts generally requiring larger feeder ports, but recognizing that a given feeder port size is generally compatible with Extracts of significantly varying viscosity.

The change in volume of the adjustable-volume Extract Reservoir 100 is directly related to the angular rotation of the cylinder top 150. Known amounts of angular rotation of the cylinder top 150 will therefore cause a known amount of Extract 140 to travel through the feeder ports 200 and into the Vaporization Chamber 110. In some embodiments of the invention, an incorporated detenting mechanism may serve to provide discrete amounts of rotation of the cylinder top 150. Detents would indicate known and regular amounts of rotation, and would therefore provide to the user an indication of the amount of Extract transferred into the Vaporization Chamber 110. In an alternative embodiment, visible graduations on the outer surface 230 of the Extract Reservoir could be used to indicate the current volume of the Extract Reservoir 100, allowing a user to know or calculate the amount of Extract that had entered the Vaporization Chamber 110.

In the event that excess Extract has entered the Vaporization Chamber 110, a user is able, to a limited extent, to cause excess Extract to flow back into the Extract Reservoir 110 by operating the device in reverse. A user may rotate the cylinder top 150 in a matter that increases cylinder volume with a resultant decrease in internal pressure. Atmospheric pressure will urge extract in the Vaporization Chamber 110 back through the feeder ports 200 and into the Extract Reservoir 100. In an embodiment, the Vaporization Chamber 110 is substantially hollow.

The preferred embodiment of the Vaporization Chamber 110 is an open-topped chamber with sides and floor made from a heat-resistant material such as metal, ceramic, glass, crystal, or thermoplastic. The sides and floor may be made from the same or differing materials. In an alternative embodiment of the device, the floor of the Vaporization Chamber 110 may be made from quartz and incorporate a small portion of heat-resistant porous material, such as porous ceramic or fritted glas, proximal to the floor and preferably centered within the floor In alternative embodiments, the porous material may partially or substantially fill the Vaporization Chamber 110. The porous material serves to keep extract in position during heating as Extract tends to disperse away from the heated quartz. Extract tends to be philic to porous materials, which causes the Extract to remain in position if it comes in contact with the porous material. Embodiments featuring a Vaporization Chamber 110 with a floor made from other materials may not benefit from the porous feature to maintain Extract position, as varying materials interact with Extract differently, and the porous feature provides much greater benefit when the Vaporization Chamber 110 material is one that causes the Extract to disperse.

The Vaporization Chamber 110 may be heated by a proximal or embedded heating element 240. In the preferred embodiment, heat energy is produced using an electric heating element 240. The heating element will produce heat energy when supplied with electric current. Electric current is typically supplied by an attachable battery, with amperage and duration provided according to battery voltage, integrated circuitry, electronic processing, and user operation of a switch or other circuit control. In the preferred embodiment, electric current is supplied while a user holds down a button or switch. In alternative embodiments of the device, the duration of the supply of electric current is timed or controlled by electronics within the battery, and must only be initiated by a user.

As the user controls the device to supply electric current through the heating element circuit, the heating element 240 increases in temperature, heat energy is transferred to the Vaporization Chamber Floor 220 via conduction with a resulting increase in Vaporization Chamber 110 temperature. The heated Vaporization Chamber 110 will transfer heat energy to any Extract contained therein, and the heated Extract will volatilize and produce Vapor.

FIG. 3 shows an isometric view of the Vaporizer. The user is able to inhale through the egress port 120 in the mouthpiece 300, which causes air from the atmosphere to enter the device through ingress ports 310 and intermix with present Vapor. The combined air and Vapor mixture is delivered to and inhaled by the user.

FIG. 4 shows an exploded isometric view of the Vaporizer. In the preferred embodiment, the Vaporizer is comprised of four (4) discreet parts which incorporate the various features detailed above. The Heating Element Assembly 400 may be made from any heat-resistant material including but not limited to metal, ceramic, thermoplastic, and composite. The Heating Element Assembly 400 of the preferred embodiment is a metal body with an embedded ceramic heating element. The Inner Wall 210 may be made from any heat-resistant material including but not limited to metal, ceramic, thermoplastic, and composite. The Inner Wall 210 of the preferred embodiment is metal. The Outer Wall 410 may be made from any structural material including but not limited to glass, polycarbonate, metal, ceramic, thermoplastic, and composite. The Outer Wall 410 of the preferred embodiment is a transparent material such as glass. The Mouthpiece 300 may be made from any structural material including but not limited to metal, plastic, ceramic, and composite. The Mouthpiece 300 of the preferred embodiment is metal.

Preferred Method of Use

In the preferred method of use, the user rotates the cylinder top causing an amount of Extract to enter the Vaporization Chamber 110. The user then operates a switch on an electrically connected battery unit that supplies electrical current to the heating element circuit. This results in an increase in the temperature of the Vaporization Chamber 110 and its contained Extract, which causes some or all of the contained Extract to vaporize. The user inhales at the mouthpiece, causing air to mix with the Vapor, and the user then inhales the Vapor-air mixture.

While preferred and alternate embodiments have been illustrated and described, as noted above, many changes can be made without departing from the spirit and scope of this IMPROVED VAPORIZER. Accordingly, the scope of the IMPROVED VAPORIZER is not limited by the disclosure of these preferred and alternate embodiments. Instead, the scope of the IMPROVED VAPORIZER is to be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed m this specification (including any accompanymg claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¦¦ 6. In particular, the use of "step of" in the claims herein is not intended to invoke the provisions of U.S.C. § 112 ¦¦ 6.

The invention claimed is:

1. An Extract vaporizer, comprising:

an adjustable-volume reservoir adapted to contain Extract, wherein said adjustable-volume reservoir comprises:

a cylinder top that is mechanically coupled to a first set of helical threads, a cylinder bottom that is mechanically coupled to a second set of helical threads, said first set of helical threads being coaxial with said cylinder top, said second set of helical threads being coaxial with said cylinder bottom, and said cylinder top and said cylinder bottom being slidably coupled to substantially enclose a reservoir volume, a vaporization chamber, wherein said reservoir and said vaporization chamber being connected by a port, a heating element proximal to said vaporization chamber, and a conduit adapted to ventilate said vaporization chamber.

2. The Extract vaporizer of claim 1, wherein said adjustable-volume reservoir is generally cylindrical.

3. The Extract vaporizer of claim 2, wherein said first and second sets of helical threads being capable of interacting to affect relative displacement of said cylinder top and said cylinder bottom, such that when said cylinder top is rotated with respect to said cylinder bottom, said first and second sets of helical threads will interact to adjust said volume of said adjustable-volume reservoir.

4. The Extract vaporizer of claim 1, further comprising a plurality of visible relative displacement graduations.

5. The Extract vaporizer of claim 1, wherein said heating element is an ohmic resistance heater.

6. The Extract vaporizer of claim 1, wherein said vaporization chamber contains a porous solid element.

7. The Extract vaporizer of claim 6, wherein said porous solid element is fritted glass.

8. An Extract vaporizer, comprising:

a reservoir adapted to contain Extract, wherein said reservoir substantially enclosing a volume, a means for adjusting said volume of said reservoir, a vaporization chamber, wherein said reservoir being in fluid communication with said vaporization chamber via a port, a vaporization chamber heating means, a conduit adapted to ventilate said vaporization chamber, and a detent mechanism for providing tactile feedback.

9. The Extract vaporizer of claim 8, further comprising:

a means for visually indicating said reservoir volume adjustment.

10. The Extract vaporizer of claim 8, wherein said detent mechanism is capable of providing the tactile feedback for reservoir volume adjustment.

11. The Extract vaporizer of claim 8, wherein said vaporization chamber contains a fritted glass element.

* * * * *